US010960997B2

(12) United States Patent
Tatsukawa

(10) Patent No.: US 10,960,997 B2
(45) Date of Patent: Mar. 30, 2021

(54) CASE SEALING DEVICE

(71) Applicant: ISHIDA CO., LTD., Kyoto (JP)

(72) Inventor: Satoshi Tatsukawa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 155 days.

(21) Appl. No.: 16/285,211

(22) Filed: Feb. 26, 2019

(65) Prior Publication Data

US 2019/0263547 A1 Aug. 29, 2019

(30) Foreign Application Priority Data

Feb. 27, 2018 (JP) ..... JP2018-033026

(51) Int. Cl.

| | |
|---|---|
| ***B65B 43/00*** | (2006.01) |
| ***B65B 7/20*** | (2006.01) |
| ***B65B 43/10*** | (2006.01) |
| ***B65B 43/14*** | (2006.01) |
| ***B65B 7/28*** | (2006.01) |

(52) U.S. Cl.

CPC ..... *B65B 7/20* (2013.01); *B65B 7/2864* (2013.01); *B65B 43/10* (2013.01); *B65B 43/14* (2013.01)

(58) Field of Classification Search

CPC .. B65B 7/00; B65B 7/20; B65B 43/00; B65B 43/10; B65B 43/01

See application file for complete search history.

(56) References Cited

U.S. PATENT DOCUMENTS 3,045,402 A 7/1962 Keely et al.
4,262,469 A 4/1981 Ooms et al.
4,551,964 A * 11/1985 Johnson ..... B65B 7/20 53/377.2
4,722,165 A 2/1988 Marchetti
4,955,177 A * 9/1990 Lerner ..... B65B 7/20 493/117
5,511,362 A 4/1996 Morita et al.
6,070,396 A 6/2000 Rinaldi et al.

(Continued)

FOREIGN PATENT DOCUMENTS

CN 105292547 A 2/2016
CN 206087410 A 4/2017

(Continued)

OTHER PUBLICATIONS

The Search Report from the corresponding European Patent Application No. 19159256.7 dated May 27, 2019.

(Continued)

*Primary Examiner* — Chelsea E Stinson
(74) *Attorney, Agent, or Firm* — Shinjyu Global IP

(57) ABSTRACT

A case sealing device is disclosed. The case sealing device conveys a cardboard box and simultaneously closes a flap group provided on edges of opening of the cardboard box. The case sealing device includes a folding member, a drive unit, and a control unit. The folding member contacts a flap of the flap group that extends along a conveyance direction of the cardboard box and folds the flap. The drive unit moves the folding member. The control unit controls the drive unit. In operation of folding the flap, a longitudinal direction of the folding member is inclined with respect to the conveyance direction such that the folding member contacts a front edge of the flap in the conveyance direction before other portions of the flap.

8 Claims, 14 Drawing Sheets

(56) References Cited

U.S. PATENT DOCUMENTS

| | | | | |
|---|---|---|---|---|
| 6,880,309 | B2 | 4/2005 | Marchetti | |
| 7,269,933 | B2 | 9/2007 | Le | |
| 9,290,281 | B2 * | 3/2016 | Iwasa | B65B 7/20 |
| 2004/0123559 | A1 * | 7/2004 | Le | B65B 51/067 53/136.4 |
| 2020/0254708 | A1 * | 8/2020 | Nakamura | B31B 50/262 |

FOREIGN PATENT DOCUMENTS

| | | | |
|---|---|---|---|
| EP | 0542341 | A1 | 5/1993 |
| JP | H06-171614 | A | 6/1994 |

OTHER PUBLICATIONS

The Office Action from the corresponding Chinese Patent Application No. 201910099841.5 dated Sep. 30, 2020.

* cited by examiner

CASE SEALING DEVICE

CROSS-REFERENCE TO RELATED APPLICATIONS

This application claims priority to Japanese Patent Application No. 2018-33026, filed Feb. 27, 2018. The contents of that application are incorporated by reference herein in their entirety.

TECHNICAL FIELD

The present disclosure relates to a case sealing device.

BACKGROUND ART

In recent years, devices that convey cardboard boxes and at the same time automatically close the flaps and tape them have become widespread. For example, JP-A No. H06-171614 discloses a case sealing device where a first-approaching front flap comes into contact with and is folded by a member provided in a predetermined position, a rear flap is folded by a swinging member from behind, and, after the front and rear flaps have been folded, left and right flaps (extending along the conveyance direction) are folded by rod-shaped folding members.

BRIEF SUMMARY

However, in the above-described case sealing device, the rod-shaped folding members come into contact with and fold, simultaneously and parallel to, the left and right flaps, so there are cases where the rod-shaped folding members cannot fold the left and right flaps along the fold lines at the bases of the flaps.

It is a problem of the present disclosure to provide a case sealing device that can reliably fold, along fold lines, flaps that extend along the conveyance direction.

A case sealing device pertaining to a first aspect of the disclosure conveys cardboard boxes and at the same time closes a flap group provided on edges of openings of the cardboard boxes. The case sealing device includes folding members, a drive unit that moves the folding members, and a control unit that controls the drive unit. The folding members come into contact with flaps of the flap group that extend along the conveyance direction of the cardboard boxes and fold the flaps. At the time of the operation of folding the flaps, longitudinal directions of the folding members are inclined with respect to the conveyance direction in such a way that the folding members come into contact with front-side front edges of the flaps in the conveyance direction before other portions of the flaps.

In this case sealing device, the folding members can gradually fold the flaps from the front-side front edges of the flaps in the conveyance direction to the rear sides, so the flaps are reliably folded along their fold lines.

A case sealing device pertaining to a second aspect of the disclosure is the case sealing device pertaining to the first aspect, wherein the folding members gradually descend after coming into contact with the front-side front edges of the flaps.

In this case sealing device, because the folding members gradually descend after coming into contact with the front-side front edges of the flaps, the folding operation becomes an operation where the folding members fold the flaps from the upper portions of the flaps to the bases, so the flaps can be folded neatly as if they were folded by hand.

A case sealing device pertaining to a third aspect of the disclosure is the case sealing device pertaining to the second aspect, wherein the folding members descend obliquely downward.

In this case sealing device, in order to fold the flaps, an operation that knocks them down from the side and at the same time holds them down from above becomes necessary, so an operation where the folding members descend obliquely downward is sensical.

A case sealing device pertaining to a fourth aspect of the disclosure is the case sealing device pertaining to the second aspect, wherein the folding members descend while revolving.

In this case sealing device, in order to fold the flaps, an operation that knocks them down from the side and at the same time holds them down from above becomes necessary, and this operation can be realized by the folding members descending while revolving.

A case sealing device pertaining to a fifth aspect of the disclosure is the case sealing device pertaining to any one of the second aspect to the fourth aspect, wherein the folding members are inclined with respect to the conveyance direction also when they are descending.

In this case sealing device, the folding operation becomes an operation where the folding members fold the flaps from the upper portions of the flaps to the bases from the front of the flaps to the rear to completely fold the flaps, so the flaps can be folded neatly as if they were folded by hand.

A case sealing device pertaining to a sixth aspect of the disclosure is the case sealing device pertaining to any one of the first aspect to the fifth aspect, wherein the angle of inclination of the longitudinal directions of the folding members with respect to the conveyance direction is in the range of 3° to 60°.

A case sealing device pertaining to a seventh aspect of the disclosure is the case sealing device pertaining to any one of the first aspect to the sixth aspect, wherein the folding members are inclined with respect to a horizontal plane when they come into contact with the flaps.

A case sealing device pertaining to an eighth aspect of the disclosure is the case sealing device pertaining to any one of the first aspect to the sixth aspect, wherein the folding members are provided for each of the flaps that extend along the conveyance direction.

In the case sealing device pertaining to the disclosure, the folding members can gradually fold the flaps from the front-side front edges of the flaps in the conveyance direction to the rear sides, so the flaps are reliably folded along their fold lines.

DETAILED DESCRIPTION

An embodiment of the disclosure will be described below with reference to the drawings. It will be noted that the following embodiment is a specific example of the disclosure and is not intended to limit the technical scope of the disclosure.

(1) Configuration of Packing System 1

Figure 1:
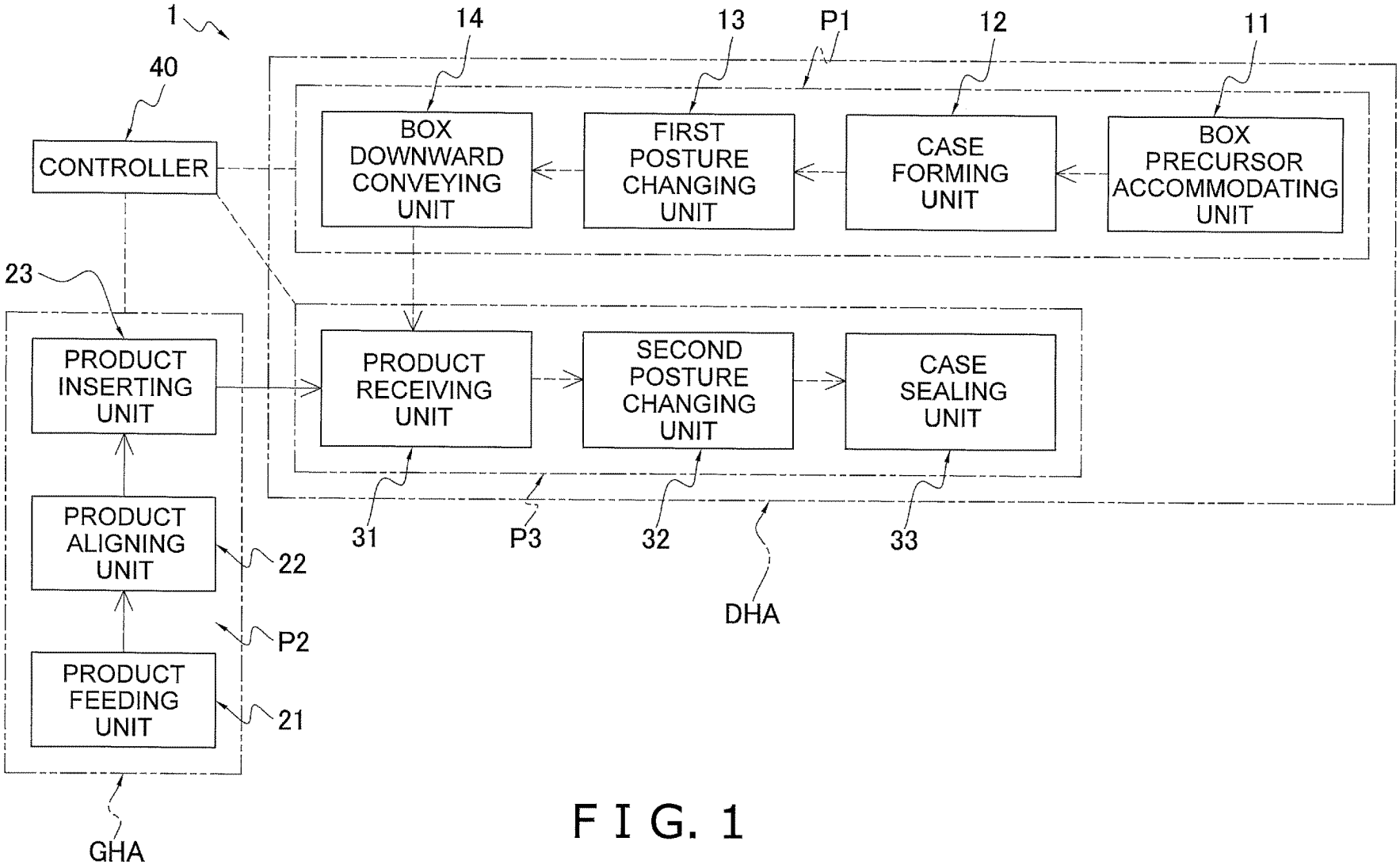
FIG. 1 is a block diagram of a packing system equipped with a case sealing device pertaining to an embodiment of the disclosure.

FIG. 1 is a block diagram of a packing system 1 equipped with a case sealing device pertaining to an embodiment of the disclosure. Furthermore, FIG. 2A is a perspective view showing the configuration of the packing system, and FIG. 2B is a perspective view showing a flow of cardboard boxes 13 and products Gin the packing system 1.

Figure 2A:
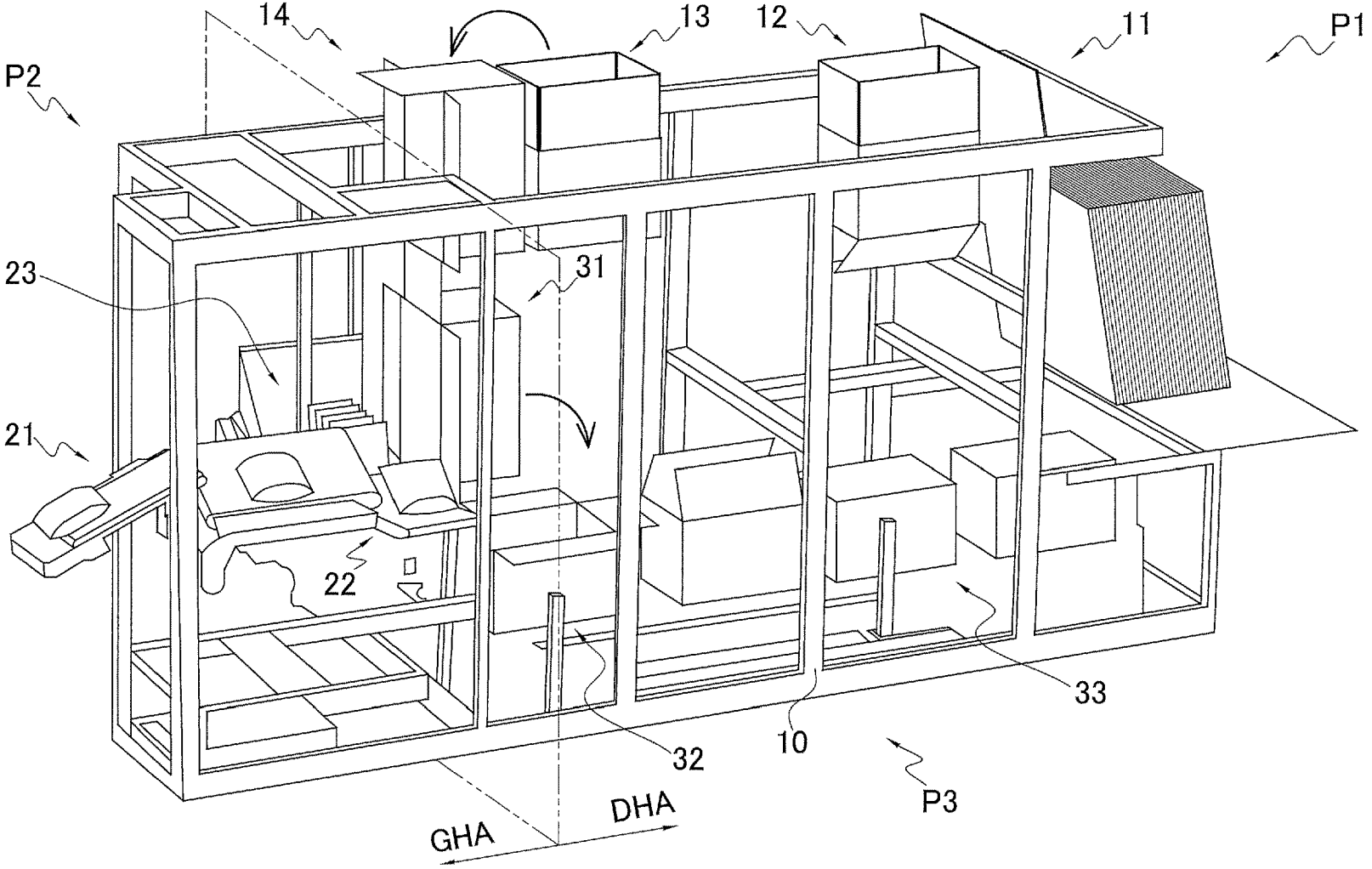
FIG. 2A is a perspective view showing the configuration of the packing system.
Figure 2B:
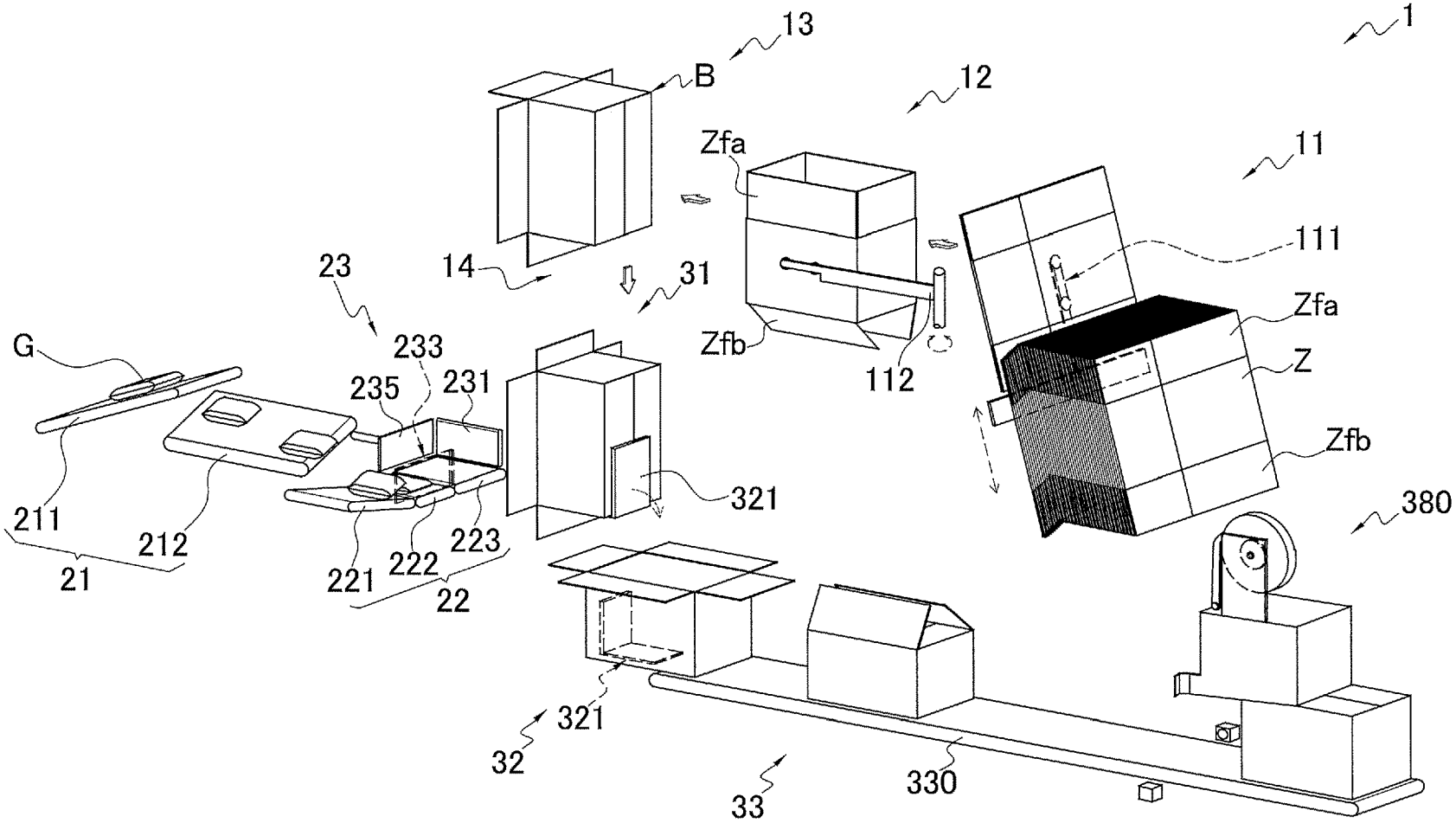
FIG. 2B is a perspective view showing a flow of cardboard boxes and products in the packing system.

In FIG. 1 and FIG. 2A, the packing system 1 is a system that packs a fixed number of bagged products (products G) such as snack foods, for example, in an aligned state and in multiple layers into cardboard boxes B.

As shown in FIG. 1 and FIG. 2A, the packing system 1 comprises a cardboard box handling area DHA and a product handling area GHA that are interconnected in a state in which they are mutually independently separable. The cardboard box handling area DHA includes two processes, a case forming process P1 and a packing process P3. The product handling area GHA includes a product aligning process P2.

That is, in the packing system 1, because the cardboard box handling area DHA and the product handling area GHA are interconnected, the three processes of the case forming process P1, the product aligning process P2, and the packing process P3 work together.

The case forming process P1 is a process of erecting sheet-like cardboard box precursors Z into cardboard boxes B and conveying the cardboard boxes B to a packing position. The case forming process P1 is configured by a box precursor accommodating unit 11, a case forming unit 12, a first posture changing unit 13, and a box downward conveying unit 14.

The product aligning process P2 is a process of feeding to a predetermined position the products G supplied from an upstream process, aligning a fixed number of the products G so that adjacent products partially lie on top of each other, and conveying the fixed number of products G to the packing position. The product aligning process P2 is configured by a product feeding unit 21, a product aligning unit 22, and a product inserting unit 23.

The packing process P3 is a process of packing, into the cardboard boxes B that have been conveyed thereto from the case forming process P1, the fixed quantity of products G that have finished being aligned in the product aligning process P2, closing the boxes, and conveying the boxes to a box discharge position. The packing process P3 is configured by a product receiving unit 31, a second posture changing unit 32, and a case sealing unit 33.

The packing system 1 performs multilayer packing of the products G into the cardboard boxes B, and the posture of the products G inside the boxes B is a "standing posture." That is, the standing posture is a posture where, when the openings of the boxes B face up, the front sides and the back sides of the products G face sideways, the upper and lower end portions of the products G face up and down, and the left and right side portions of the products G face sideways.

Furthermore, as shown in FIG. 2A and FIG. 2B, the cardboard box handling area DHA has a two-level structure, and the case forming process P1 and the packing process P3 are supported by a common frame 10. The case forming process P1 occupies the second-level portion, and the packing process P3 occupies the first-level portion.

In order to realize this two-level structure, the conveyance direction of the cardboard boxes B from the erection of the cardboard boxes B by the case forming unit 12 to the box downward conveying unit 14 and the conveyance direction of the cardboard boxes B up to when the openings of the cardboard boxes B that have been packed with the products G are sealed by the case sealing unit 33 are mutually opposite directions.

(2) Detailed Configuration of Case Forming Process P1

As shown in FIG. 2B, the case forming process P1 is configured by the box precursor accommodating unit 11 that introduces the cardboard box precursors Z to the packing system 1, the case forming unit 12 that erects the cardboard boxes B, the first posture changing unit 13 that rotates the cardboard boxes B by 90° about a horizontal axis orthogonal to the conveyance direction, and the box downward conveying unit 14 that conveys downward the cardboard boxes B that have been switched to a first posture.

(2-1) Box Precursor Accommodating Unit 11

The box precursor accommodating unit 11, as shown in FIG. 2B, picks one at a time and transports upward the cardboard box precursor Z at the very front of the cardboard box precursors Z stacked in a supply position, rotates the transported cardboard box precursor Z by 90° about a vertical axis, and opens it into a tubular shape.

The cardboard box precursors Z are placed in the supply position by a worker. The cardboard box precursors Z are collapsed with their flaps Zf open and are stacked in a horizontal direction in a posture in which the flaps Zf are positioned in the vertical direction. It will be noted that for convenience of description the flaps Zf on the top surface side will be called top flaps Zfa and the flaps Zf on the bottom surface side will be called bottom flaps Zfb.

The upward transport of the cardboard box precursors Z is performed by a lift mechanism 111. When all the cardboard box precursors Z in the supply position run out, a detection sensor (not shown in the drawings) sends a detection signal to a controller 40 (see FIG. 1).

Furthermore, the rotation of the cardboard box precursors Z about the vertical axis is realized by sucking and holding, with suckers, the side surfaces of the cardboard box precursors Z with a sucking and rotating mechanism 112 and rotating the sucking and rotating mechanism 112 90° about the vertical axis.

(2-2) Case Forming Unit 12

The case forming unit 12 conveys in a horizontal direction the cardboard box precursors Z that have been opened into a tubular shape and at the same time folds and tapes the bottom flaps Zfb of the cardboard box precursors Z to thereby erect the cardboard boxes B in a state in which the top flaps Zfa are open.

(2-3) First Posture Changing Unit 13

The first posture changing unit 13 rotates the cardboard boxes B by 90° in the conveyance direction. More specifically, the first posture changing unit 13 rotates the cardboard boxes B by 90° about a horizontal axis orthogonal to the conveyance direction to thereby change the posture of the cardboard boxes B to a posture (hereinafter called a first posture) in which the openings and the top flaps Zfa of the cardboard boxes B are in the same vertical plane. When the cardboard boxes B are in the first posture, the openings face the product handling area GHA.

(2-4) Box Downward Conveying Unit 14

The box downward conveying unit 14 conveys downward the cardboard boxes B that have been switched to the first posture. That is, the box downward conveying unit 14 moves the cardboard boxes B downward with the openings of the cardboard boxes B kept facing the product handling area GHA.

(3) Detailed Configuration of Product Aligning Process P2

Disposed upstream of the product aligning process P2 in terms of the flow of the products G in the packing system 1 are a weigher, a bag-making and packaging machine, and the like not shown in the drawings. Only products G that have passed, for example, weight, seal, and contamination inspections in the upstream process are supplied to the product aligning process P2 the packing system 1.

The product aligning process P2 is configured by the product feeding unit 21 that accepts the products G and conveys them to a predetermined position, the product aligning unit 22 that aligns the products G supplied from the product feeding unit 21, and the product inserting unit 23 that accumulates and pushes out the aligned products G.

(3-1) Product Feeding Unit 21

The product feeding unit 21 has a product introducing conveyor 211 and a feeding conveyor 212. The product introducing conveyor 211 receives, downstream of the process that performs, for example, the weight, seal, and contamination inspections, the supply of the products G that have passed the inspections and leads those products G to the feeding conveyor 212.

The feeding conveyor 212 conveys to the product aligning unit 22 the products G conveyed thereto from the product introducing conveyor 211.

(3-2) Product Aligning Unit 22

The product aligning unit 22 has a first aligning conveyor 221, a second aligning conveyor 222, and a third aligning conveyor 223. The product aligning unit 22 is a unit that conveys the products G to a predetermined position while performing an accumulating operation with respect to the products G The product aligning unit 22 is particularly suited to the accumulation of bag packages, so it can also be used independently as a package accumulating device.

The first aligning conveyor 221, in order to receive the products G that drop thereto from the feeding conveyor 212, has one end set in a lower position than the height of the distal end portion of the feeding conveyor 212 and has the other end set in the height position of the second aligning conveyor 222.

After the product G at the rear of the line lands on the first aligning conveyor 221, the first aligning conveyor 221, the second aligning conveyor 222, and the third aligning conveyor 223 simultaneously perform a conveying operation in the same direction. For that reason, an N-number of the products G aligned in a line on the first aligning conveyor 221 and the second aligning conveyor 222 move in unison toward the third aligning conveyor 223 and advance on the third aligning conveyor 223.

The third aligning conveyor 223 conveys, in front of the openings of the cardboard boxes B standing by, the group of products G aligned by the first aligning conveyor 221 and the second aligning conveyor 222. The third aligning conveyor 223 doubles as an element of the product inserting unit 23 described below.

(3-3) Product Inserting Unit 23

The product inserting unit 23 sandwiches the front and rear of the group of products G aligned in a line by the third aligning conveyor 223 and inserts the whole group of products G into the cardboard boxes B. As shown in FIG. 2B, the product inserting unit 23 has a stand-up conveyor 231, a push-toward plate 233, and an insertion plate 235 in order to sandwich the aligned group of products G.

(3-3-1) Stand-Up Conveyor 231

The stand-up conveyor 231 is provided over the downstream end of the third aligning conveyor 223 and blocks the advance of the products G forming a line and being conveyed thereto. The stand-up conveyor 231 is disposed in such a way that its conveyance surface is always orthogonal to the conveyance direction of the products G.

The conveyance surface of the stand-up conveyor 231 moves vertically upward a little before the products G come into contact with the conveyance surface of the stand-up conveyor 231. Then, when the leading end of the product G at the front comes into contact with the conveyance surface of the stand-up conveyor 231, an upward force acts on the leading end of the product U, and the horizontal movement of the product G by the third aligning conveyor 223 also continues, so the product U at the front can reliably stand up.

(3-3-2) Push-Toward Plate 233

The push-toward plate 233 pushes the product at the rear of the N-number of products U aligned in a line to thereby sandwich the products U between itself and the stand-up conveyor 231 and cause the products G to stand up.

The push-toward plate 233 is provided on the upstream end side of the third aligning conveyor 223, but while the line of products G is moving from the second aligning conveyor 222 to the third aligning conveyor 223, the push-toward plate 233 is accommodated on the side of the third aligning conveyor 223 so that its flat surface portion is parallel to the conveyance direction of the products G. Furthermore, when the product G at the rear of the line has completely transferred from the second aligning conveyor 222 to the third aligning conveyor 223, the push-toward plate 233 swings so that its flat surface portion becomes orthogonal to the conveyance direction of the products G. Moreover, the push-toward plate 233 pushes the product G at the rear of the line to thereby push the entire line toward the stand-up conveyor 231.

At this time, the conveyance surface of the stand-up conveyor 231 is moving vertically upward, so the product G at the front of the line stands up along the conveyance surface of the stand-up conveyor 231, and the next product G stands up along the product G at the front that has been made to stand up. The subsequent products G also successively stand up because of the same operation, so the N-number of products G become aligned in a standing state.

Furthermore, the product inserting unit 23 collectively pushes, via the insertion plate 235, the N-number of products G in the standing state into the cardboard boxes B. The insertion plate 235 is positioned on the opposite side of the position of the cardboard boxes B across the third aligning conveyor 223. When viewed from the second aligning conveyor 222 side, the open surfaces of the cardboard boxes B are positioned on the right side of the third aligning conveyor 223 and the insertion plate 235 is positioned on the left side of the third aligning conveyor 223.

(3-3-3) Insertion Plate 235

The insertion plate 235 stands by with its flat surface portion opposing the openings of the cardboard boxes B. After the N-number of products G have been switched to the standing state, the insertion plate 235 pushes the N-number of products G toward the open surfaces of the cardboard boxes B and in one fell swoop inserts the N-number of products G through the openings to the bottoms of the cardboard boxes B. The insertion plate 235 crosses between the stand-up conveyor 231 and the push-toward plate 233 and advances to the open surfaces of the cardboard boxes B.

(4) Detailed Configuration of Packing Process P3

The packing process P3 has the product receiving unit 31 that receives the products G into the cardboard boxes B, the second posture changing unit 32 that changes the posture of the cardboard boxes so that the openings of the cardboard boxes face up, and the case sealing unit 33 that convey the cardboard boxes B that have finished being packed with the products G and at the same time closes the openings of the cardboard boxes B.

(4-1) Product Receiving Unit 31

The product receiving unit 31 maintains the cardboard boxes B in the first posture and has the cardboard boxes B stand by with the openings of the cardboard boxes B opposing the insertion plate 235 of the product inserting unit 23. The N-number of products G that have been switched to the standing state in the product inserting unit 23 are pushed out by the insertion plate 235 toward the open surfaces in the cardboard boxes B, so the product receiving unit 31 stands by in that position until the N-number of products G are completely inserted through the openings to the bottoms of the cardboard boxes B.

When a first layer of the N-number of products G is inserted into a cardboard box B, the product receiving unit 31 descends a predetermined distance. Then, in order to receive a second layer of the N-number of products G, the product receiving unit 31 has the cardboard box B stand by in such a way that the portion of the opening of the cardboard box B that leads to the space above the first layer opposes the insertion plate 235.

The product receiving unit 31 repeats the above-described operation so that an i-th layer of the N-number of products G is inserted into the cardboard box B, and the receiving of the products into the cardboard box B is finished.

(4-2) Second Posture Changing Unit 32

As shown in FIG. 2B, the second posture changing unit 32 has a posture changing mechanism 321 that changes the posture of the cardboard boxes B packed with the products G to a posture in which the openings face up.

The posture changing mechanism 321 rotates the cardboard boxes 13 so that the open surfaces that had been vertical until then become horizontal, namely, so that the open surfaces face up. The posture changing mechanism 321 uses an L-shaped member with suckers that simultaneously suck the side surface and the bottom surface of the cardboard boxes B to hold the cardboard boxes B, and when the L-shaped member rotates by 90°, the cardboard boxes B rotate.

(4-3) Case Sealing Unit 33

As shown in FIG. 2B, the case sealing unit 33 has a discharge conveyor 330 that conveys the cardboard boxes B, a flap closing mechanism 340 (see FIG. 3A) that closes the flaps around the openings of the cardboard boxes B, a side surface pushing mechanism 355 (see FIG. 4D) that pushes the side surfaces of the cardboard boxes, and a tape applicator 380 that seals the openings closed by the flaps.

(4-3-1) Discharge Conveyor 330

When the cardboard boxes B have been rotated by 90° with the posture changing mechanism 321, the cardboard boxes B are placed on the discharge conveyor 330 in a state in which the openings face up. The discharge conveyor 330 conveys the cardboard boxes B to the discharge position.

(4-3-2) Flap Closing Mechanism 340

Figure 3A:
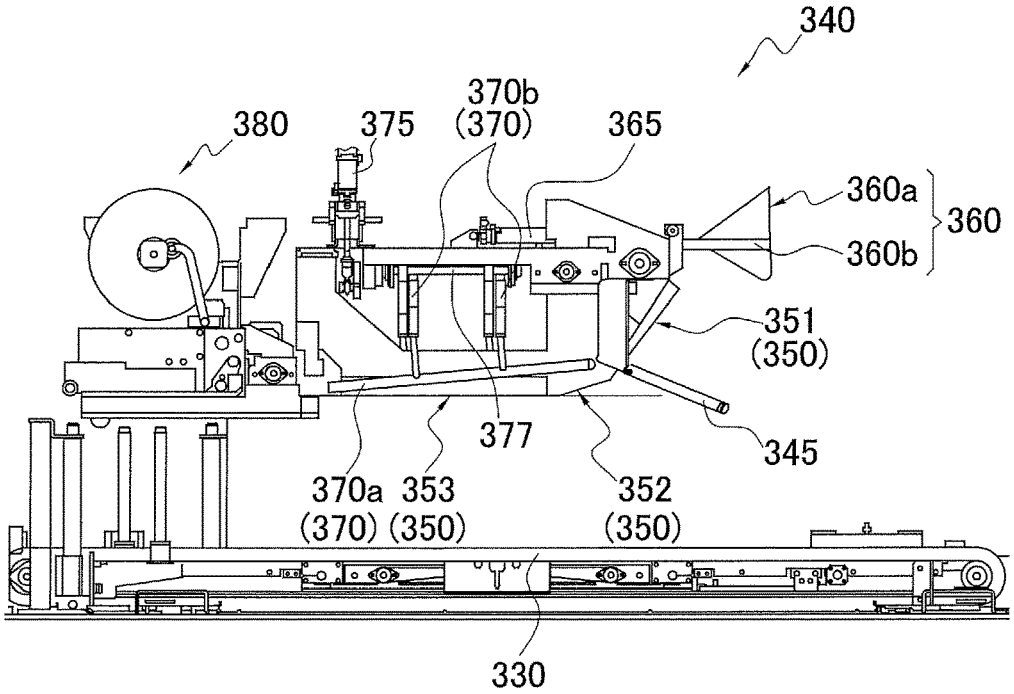
FIG. 3A is a front view of the region around a flap closing mechanism when a cardboard box has not been conveyed thereto.

FIG. 3A is a front view of the region around the flap closing mechanism 340 when a cardboard box B has not been conveyed thereto. Furthermore, FIG. 3B is a front view of the region around the flap closing mechanism 340 when a cardboard box B has been conveyed thereto.

Figure 3B:
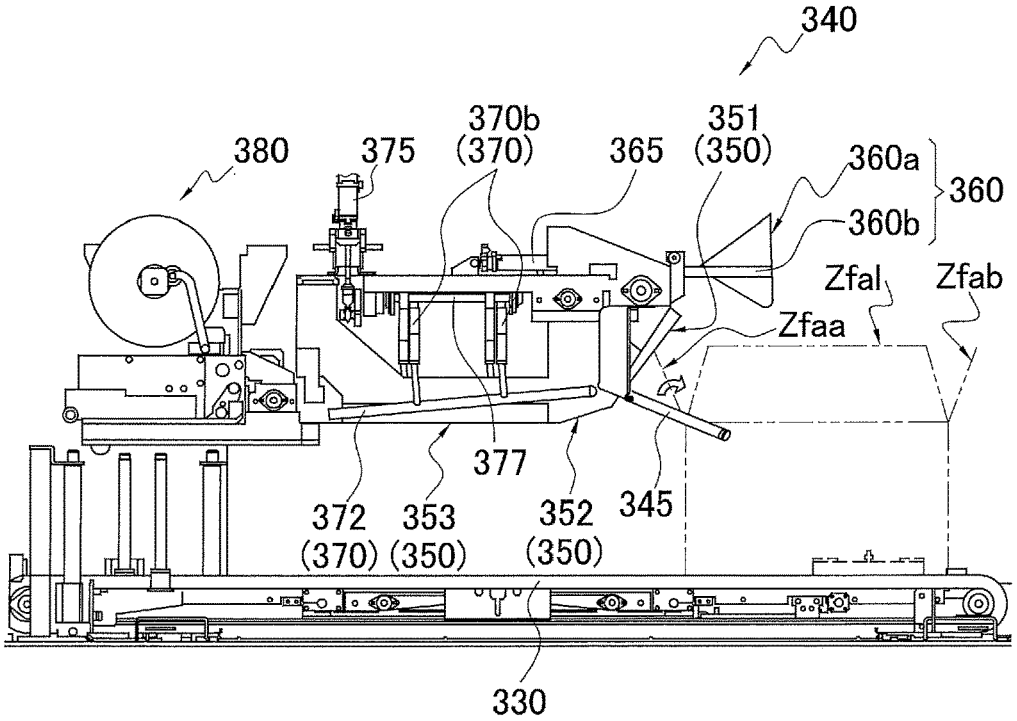
FIG. 3B is a front view of the region around the flap closing mechanism when a cardboard box has been conveyed thereto.
Figure 3C:
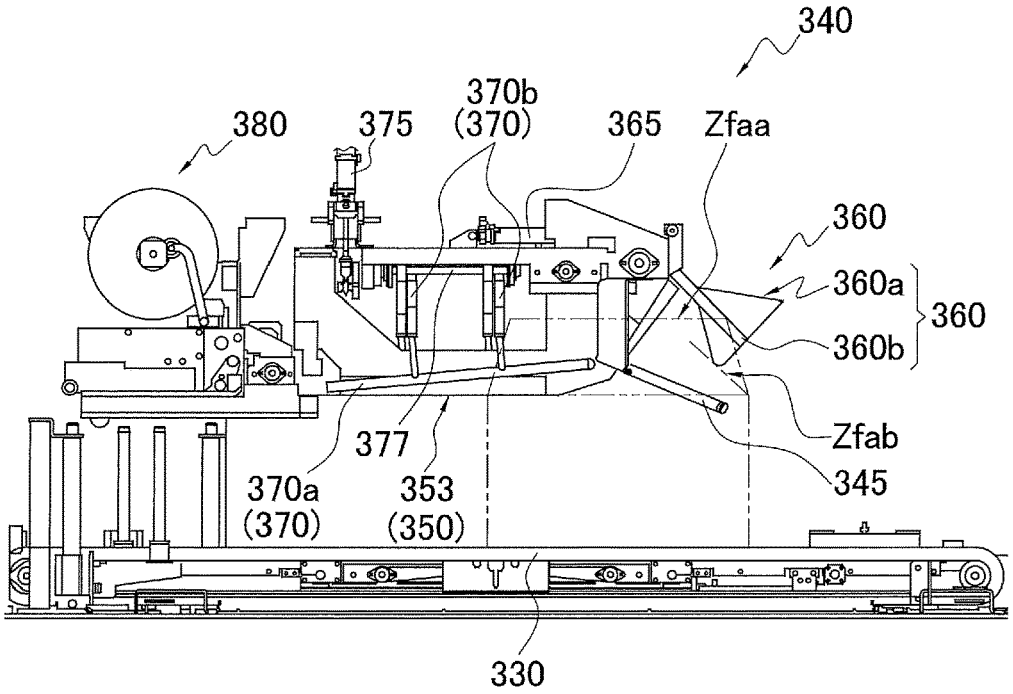
FIG. 3C is a front view of the region around the flap closing mechanism as a rear flap is in the middle of being folded.
Figure 3D:
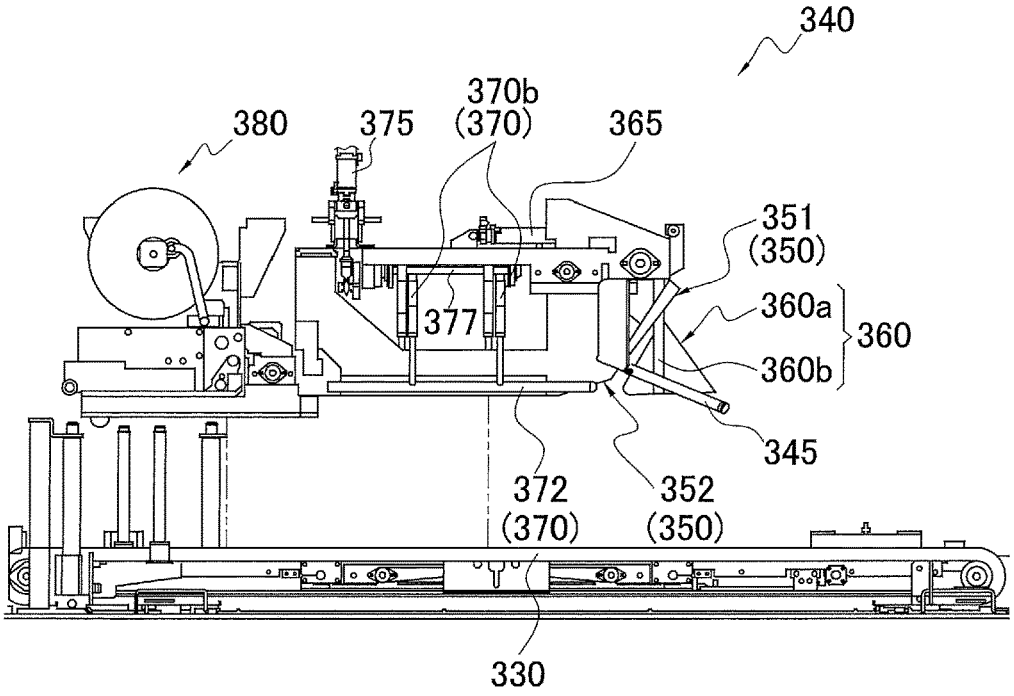
FIG. 3D is a front view of the region around the flap closing mechanism when folding bars have descended to a lowest point.

Furthermore, FIG. 3C is a front view of the region around the flap closing mechanism 340 as a rear flap Zfab is in the middle of being folded. Moreover, FIG. 3D is a front view of the region around the flap closing mechanism 340 when folding bars 370*a* have descended to a lowest point.

In FIG. 3A to FIG. 3C, the flap closing mechanism 340 has a front flap folding member 350, a rear flap folding member 360, and left/right flap folding members 370. The cardboard box B is placed on the discharge conveyor 330 in such a way that its longitudinal direction is parallel to the conveyance direction, and, first, the front flap folding member 350 closes a front flap Zfaa positioned on the front edge of the opening as viewed from the conveyance direction. Next, the rear flap folding member 360 closes a rear flap Zfab positioned on the rear edge of the opening as viewed from the conveyance direction. Next, the left/right flap folding members 370 close a left flap Zfal and a right flap Zfar positioned on the left edge and the right edge of the opening as viewed from the conveyance direction.

It will be noted that before the flap closing mechanism 340 folds the front flap Zfaa, the front edges of the left flap Zfal and the right flap Zfar come into contact with left/right flap raising members 345 so that the left flap Zfal and the right flap Zfar that are open outward become tilted inward.

(4-3-2-1) Left/Right Flap Raising Members 345

The left/right flap raising members 345 are a fixed pair of extension members and have a configuration where the distance that separates them increases heading outward and downward toward their distal ends. The left/right flap raising members 345 wait to receive at their two distal end portions the left flap Zfal and the right flap Zfar of the cardboard box B conveyed thereto, and after the front ends of the left flap Zfal and the right flap Zfar come into contact with the distal end portions, the front ends proceed along the left/right flap raising members 345, so the left flap Zfal and the right flap Zfar become scooped up and tilt inward closer to each other.

(4-3-2-2) Front Flap Folding Member 350

In FIG. 3A, the front flap folding member 350 has a first inclined surface 351, a second inclined surface 352, and a horizontal surface 353.

The first inclined surface 351 is a surface inclined about 50° upward with respect to a horizontal plane. The second inclined surface 352 is a surface inclined about 15° upward with respect to a horizontal plane. The lower end of the first inclined surface 351 is connected to the upper end of the second inclined surface 352, and the lower end of the second inclined surface 352 is connected to one end of the horizontal surface 353.

In FIG. 3B, the front edge of the front flap Zfaa. of the cardboard box B comes into contact with the first inclined surface 351 of the front flap folding member 350, and the front edge of the front flap Zfaa is knocked down backward (the direction of the white arrow in FIG. 3B).

When the cardboard box B is conveyed further, the upper surface of the front flap Zfaa that has been knocked down is knocked down further by the second inclined surface 352. Thereafter, when the cardboard box B is conveyed further, the upper surface of the front flap Zfaa is knocked down until it becomes substantially horizontal by the horizontal surface 353, and the folding of the front flap Zfaa finishes.

(4-3-2-3) Side Surface Pushing Mechanism 355

Figure 4A:
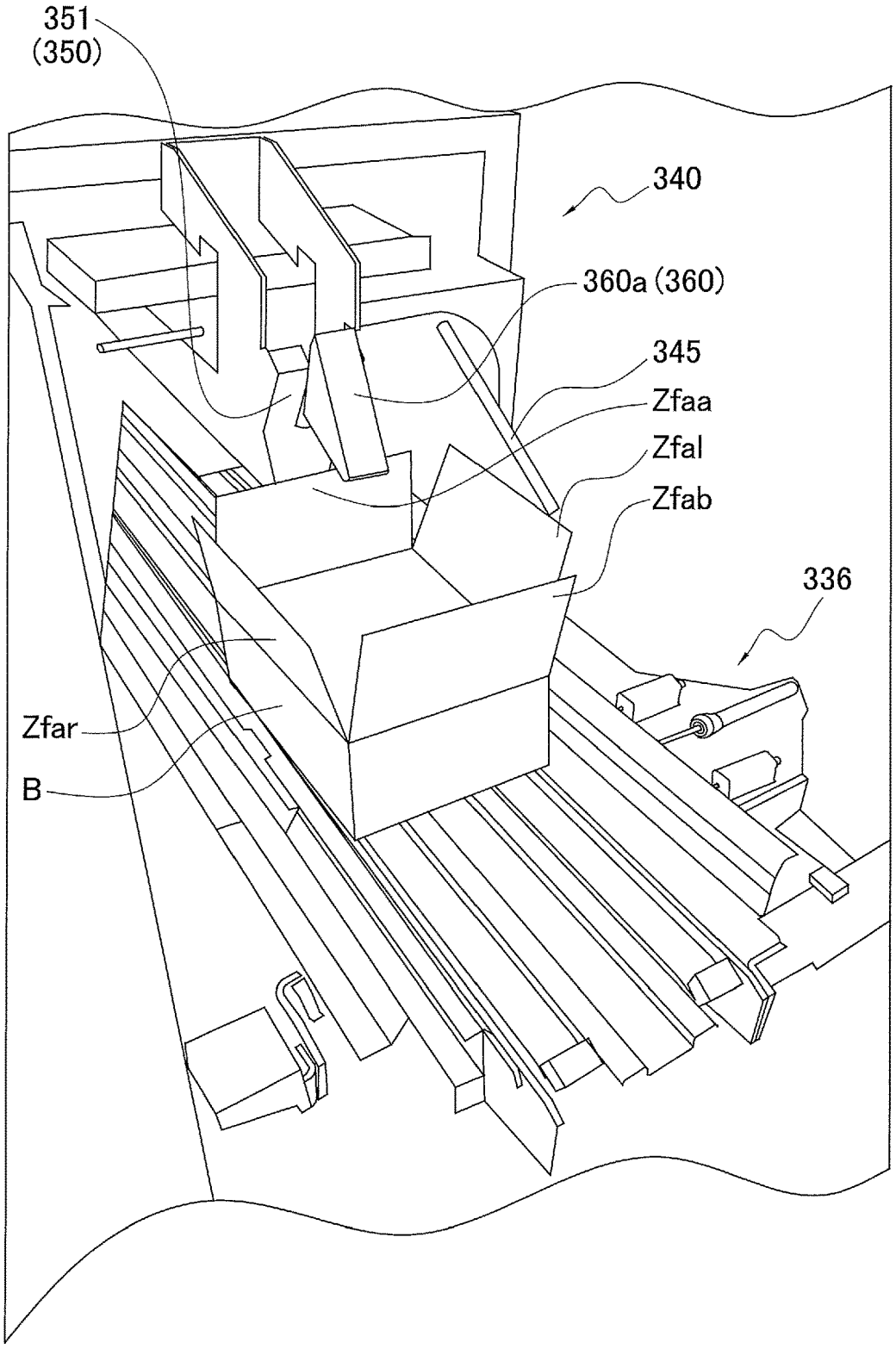
FIG. 4A is a perspective view of the region around the flap closing mechanism just before a front flap of the cardboard box comes into contact with a front flap folding member.
Figure 4B:
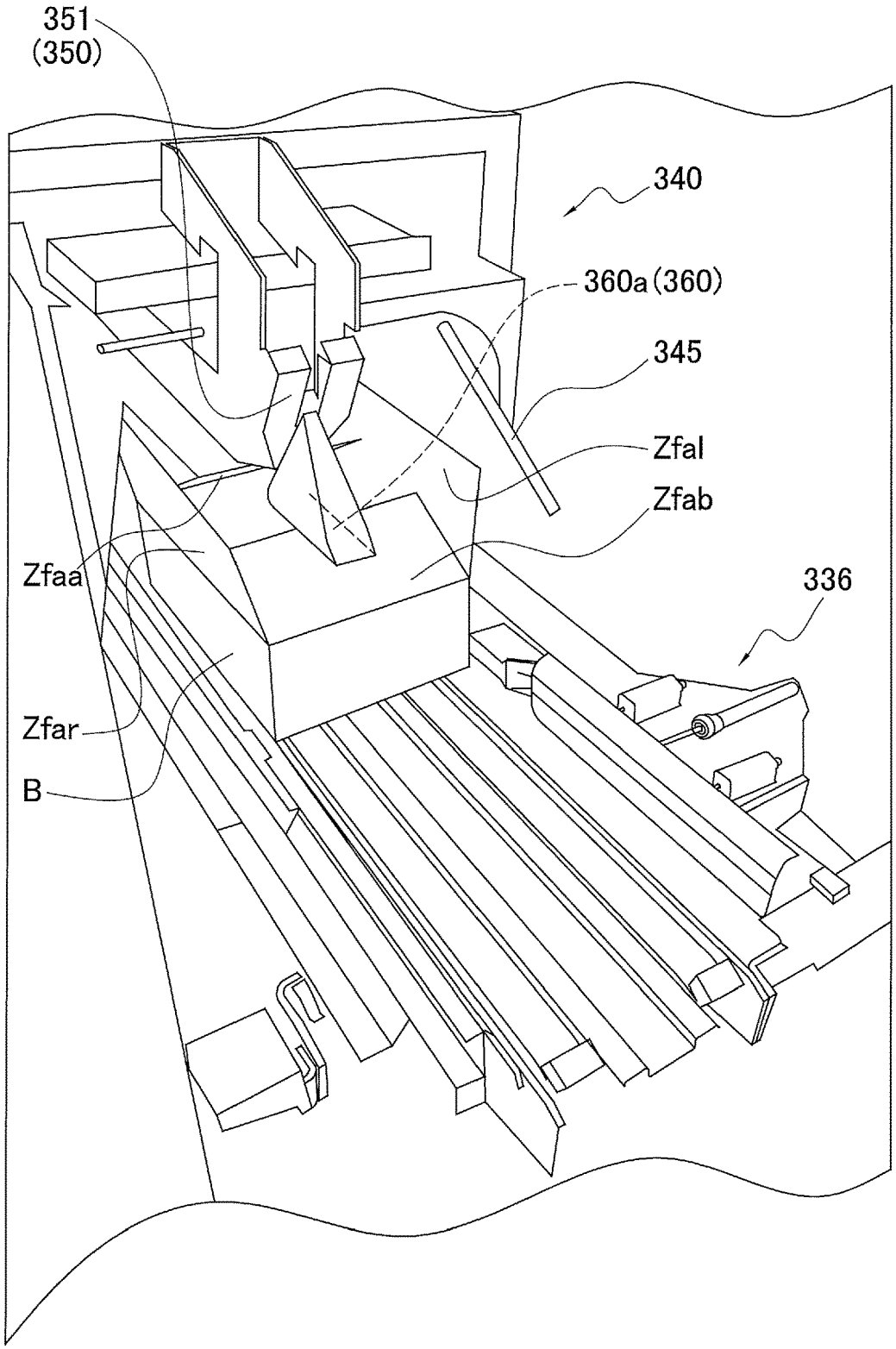
FIG. 4B is a perspective view of the region around the flap closing mechanism when the front flap of the cardboard box is being folded by the front flap folding member.

FIG. 4A shows the region around the flap closing mechanism 340 just before the front flap Zfaa of the cardboard box B comes into contact with the front flap folding member 350. FIG. 4B shows the region around the flap closing mechanism 340 when the front flap Zfaa of the cardboard box B is being folded by the front flap folding member 350.

When, in FIG. 4A and FIG. 4B, the front end of the front flap Zfaa of the cardboard box B comes into contact with the first inclined surface 351 of the front flap folding member 350, there is the concern that the front of the cardboard box B will be lifted up by the reaction thereto.

Furthermore, when the front end of the front flap Zfaa of the cardboard box B comes into contact with the first inclined surface 351 of the front flap folding member 350, the conveyance of the cardboard box B becomes braked, so there is also the concern that the back of the cardboard box B will be lifted up.

Therefore, in the present embodiment, in order to prevent uplift of the cardboard box B, a side surface pushing mechanism that can push the side surface of the cardboard box B that is on the invisible side in FIG. 4A and FIG. 4B is provided.

Figure 4C:
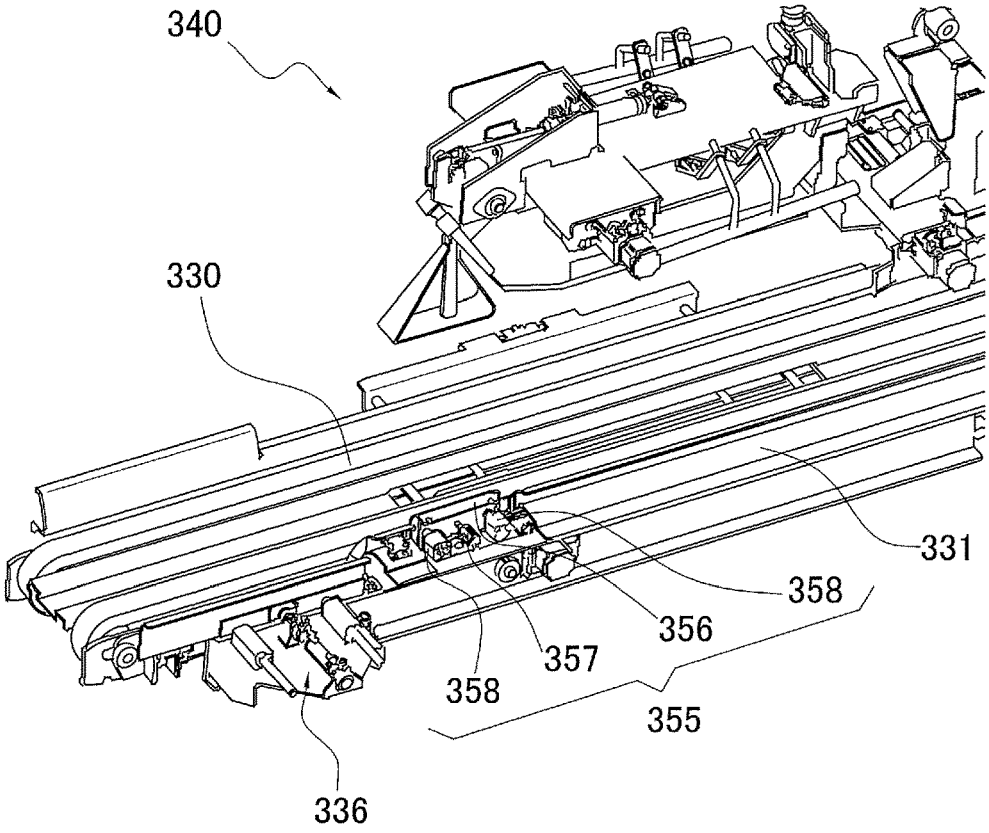
FIG. 4C is a perspective view of the region around a side surface pushing mechanism.

FIG. 4C is a perspective view of the region around the side surface pushing mechanism 355. Furthermore, FIG. 4D is a perspective view of the side surface pushing mechanism.

Figure 4D:
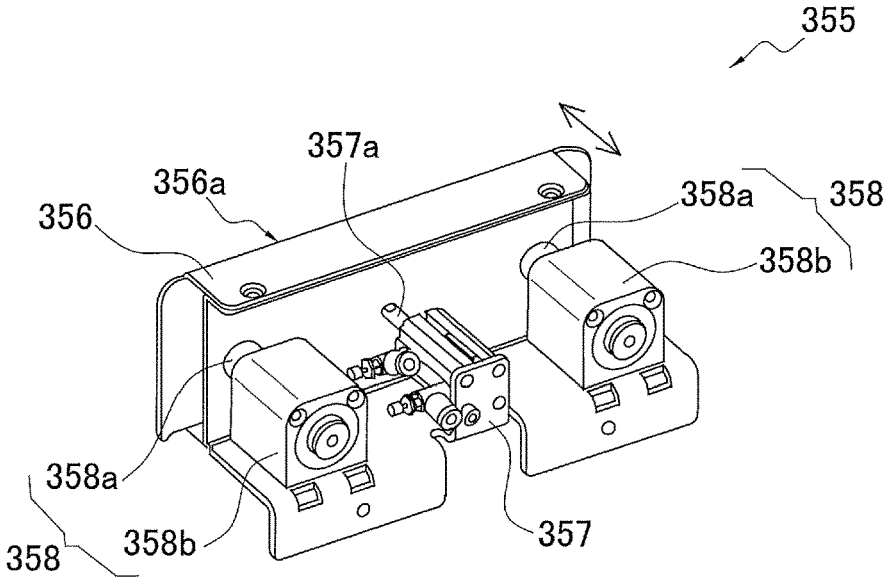
FIG. 4D is a perspective view of the side surface pushing mechanism.

In FIG. 4C and FIG. 4D, a guide plate 331 that guides, along the discharge conveyor 330, the side surface of the lower portion of the cardboard box B that flows on the discharge conveyor 330 is provided on the side of the discharge conveyor 330, and the side surface pushing mechanism 355 is provided upstream of the guide plate 331 in the conveyance direction.

The side surface pushing mechanism 355 includes a side surface pushing member 356, a side surface pushing air cylinder 357, and support shaft guides 358. The side surface pushing member 356 has a friction surface 356*a*. The friction surface 356*a* is normally positioned in the same plane as the guide plate 331.

The side surface pushing air cylinder 357 has a piston 357*a* that is reciprocally moved by air pressure. The piston 357*a* is coupled to the opposite side of the friction surface 356*a* of the side surface pushing member 356 so that it can push out the friction surface 356*a* of the side surface pushing member 356 onto the conveyance surface of the discharge conveyor 330.

The support shaft guides 358 each have a support shaft 358*a* and a bearing 358*b*. The support shafts 358*a* support the side surface pushing member 356 from the opposite side of the friction surface 356*a*. The bearings 358*b* guide the support shafts 358*a* along the moving direction of the piston 357*a* of the side surface pushing air cylinder 357. In the present embodiment, a total of two support shaft guides 358 are disposed one each on the left and right sides of the side surface pushing air cylinder 357.

It is difficult to stabilize the posture of the side surface pushing member 356 with just the piston 357*a* of the side surface pushing air cylinder 357, so by having the support shafts 358*a* of the support shaft guides 358 support the side surface pushing member 356 from both sides of the piston 357*a*, the side surface pushing member 356 can reciprocally move in a stable posture.

Furthermore, the side surface pushing mechanism 355 not only has the role of preventing uplift of the cardboard box B but also fulfills the function of preventing the cardboard box B from sliding forward when the rear flap is folded.

In the above configuration, when the cardboard box B passes by the friction surface 356*a* of the side surface pushing member 356, the controller 40 causes the piston 357*a* of the side surface pushing air cylinder 357 to advance forward in the direction of the side surface of the cardboard box B so that a predetermined force acts with respect to the side surface pushing air cylinder 357.

The predetermined force is set to an extent that does not hinder the conveyance of the cardboard box B and to an extent that the front or the back of the cardboard box B does not lift up, and about 20 N is preferred.

When the front flap Zfaa of the cardboard box B is folded backward by the first inclined surface 351, the side surface of the cardboard box B is away from the friction surface 356*a* of the side surface pushing member 356, so the controller 40 stops the supply of pressure to the side surface pushing air cylinder 357.

It will be noted that in FIG. 4A to FIG. 4D a posture adjustment pushing mechanism 336 having the same mechanism as the side surface pushing mechanism 355 is disposed on the side of the discharge conveyor 330 and upstream of the side surface pushing mechanism 355.

The posture adjustment pushing mechanism 336 pushes the side surface of the cardboard box B to thereby force the posture of the cardboard box B that has been rotated by 90° with the posture changing mechanism 321 and placed on the discharge conveyor 330 into a posture along the conveyance direction of the discharge conveyor 330.

(4-3-2-4) Rear Flap Folding Member 360

In FIG. 3C, the rear flap folding member 360 folds the rear flap Zfab at the timing when the front flap Zfaa of the cardboard box B moves under the horizontal surface 353 of the front flap folding member 350.

The rear flap folding member 360 is a member that is swung by an air cylinder 365. The rear flap folding member 360 has a hold-down plate 360*a* that is bent in a triangular shape and a transmission rod 360*b* that transmits the displacement of a piston of the air cylinder 365 to the hold-down plate 360*a*.

When the controller 40 has judged that the front flap Zfaa of the cardboard box B has moved under the horizontal surface 353 of the front flap folding member 350, the controller 40 drives the air cylinder 365 to thereby cause the hold-down plate 360*a* to swing in a clockwise direction in the front view of FIG. 3C.

As shown in FIG. 4B, the hold-down plate 360*a* swings while holding down the upper surface of the rear flap Zfab. When the hold-down plate 360*a* has swung 90°, the rear flap Zfab becomes folded substantially horizontally.

(4-3-2-5) Left/Right Flap Folding Members 370

As shown in FIG. 3A, FIG. 3B, and FIG. 3C, the left/right flap folding members 370 each have a folding bar 370*a* and two arms 370*b*. The folding bar 370*a* stands by in a higher position than the horizontal surface 353 of the front flap folding member 350.

One end of each arm 370*b* is coupled to the folding bar 370*a*. Furthermore, the arms 370*b* extend in such a way as to intersect the longitudinal direction of the folding bar 370*a* and to a higher position than the folding bar 370*a*. The other ends of the arms 370*b* are connected to a crankshaft 377 that is operated by a folding air cylinder 375.

In reality, the left/right flap folding members 370 are disposed on the near side and the far side in the front views of FIG. 3A, FIG. 3B, and FIG. 3C and stand by with the leading ends of the folding bars 370*a* pointing upward and more outward than the trailing ends. That is, one folding bar 370*a* corresponds to each of the left flap Zfal and the right flap Zfar.

Figure 5:
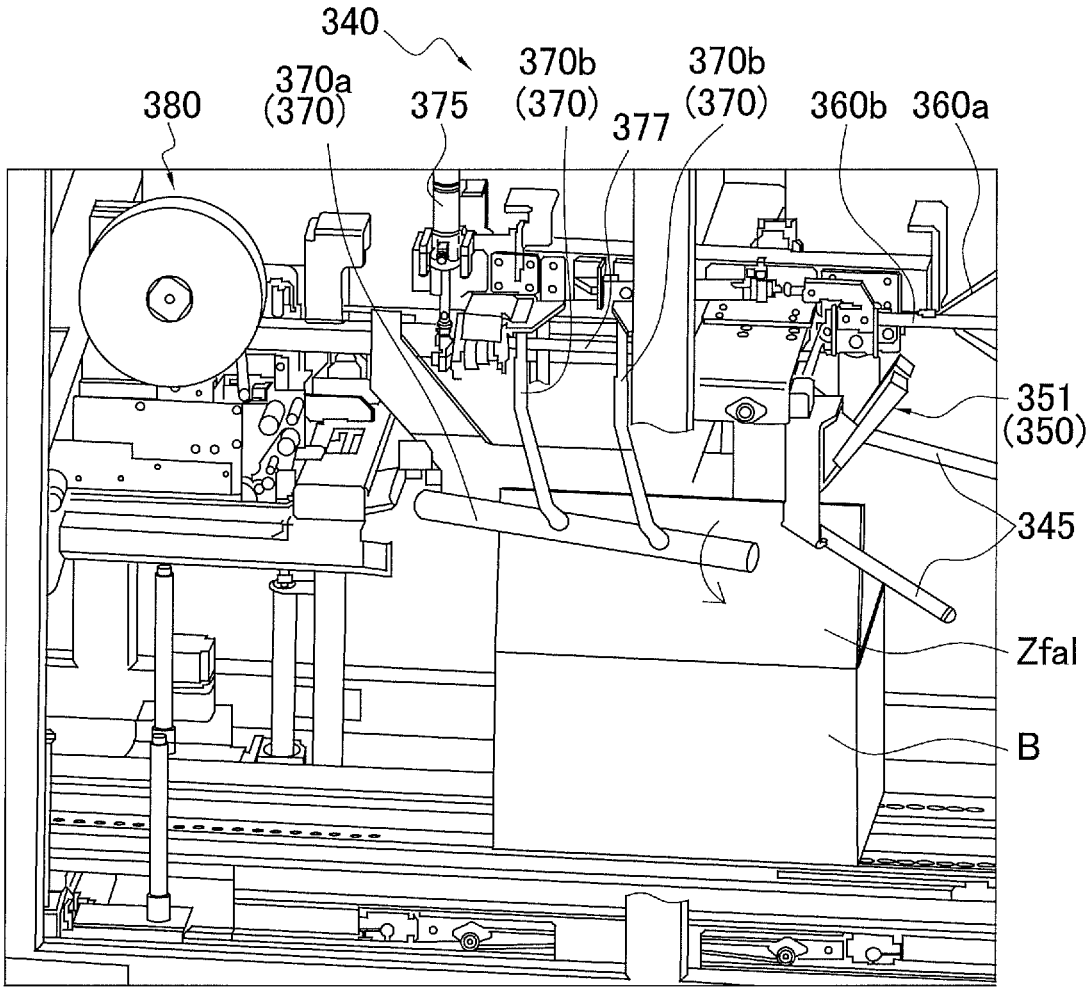
FIG. 5 is a front view of the region around the flap closing mechanism when a left flap of the cardboard box is contacting a folding bar.

Furthermore, FIG. 5 is a front view of the region around the flap closing mechanism 340 when the left flap Zfal of the cardboard box B is contacting the folding bar 370*a*. In FIG. 5, the longitudinal direction of the folding bar 370*a* is inclined with respect to the conveyance direction of the cardboard box B, so the front-side front edges of the left flap Zfal and the right flap Zfar come into contact with the folding bars 370*a* before any other part of the left flap Zfal and the right flap Zfar. It will be noted that the angle of inclination of the longitudinal direction of the folding bars 370*a* with respect to the conveyance direction is within the range of 3° to 60°, but preferably is 30°.

Around substantially the same time as when the front edges of the left flap Zfal and the right flap Zfar of the cardboard box B come into contact with the left/right flap folding members 370, the controller 40 operates the folding air cylinder 375 to thereby cause the folding bars 370*a* to descend while revolving. The folding bars 370*a* are inclined with respect to the conveyance direction also when they descend while revolving.

In FIG. 3D, when the folding bars 370*a* descend to a lowest point, the folding bars 370*a* become substantially horizontal as viewed in the front view of FIG. 3D and so can reliably fold the left flap Zfal and the right flap Zfar.

Figure 6:
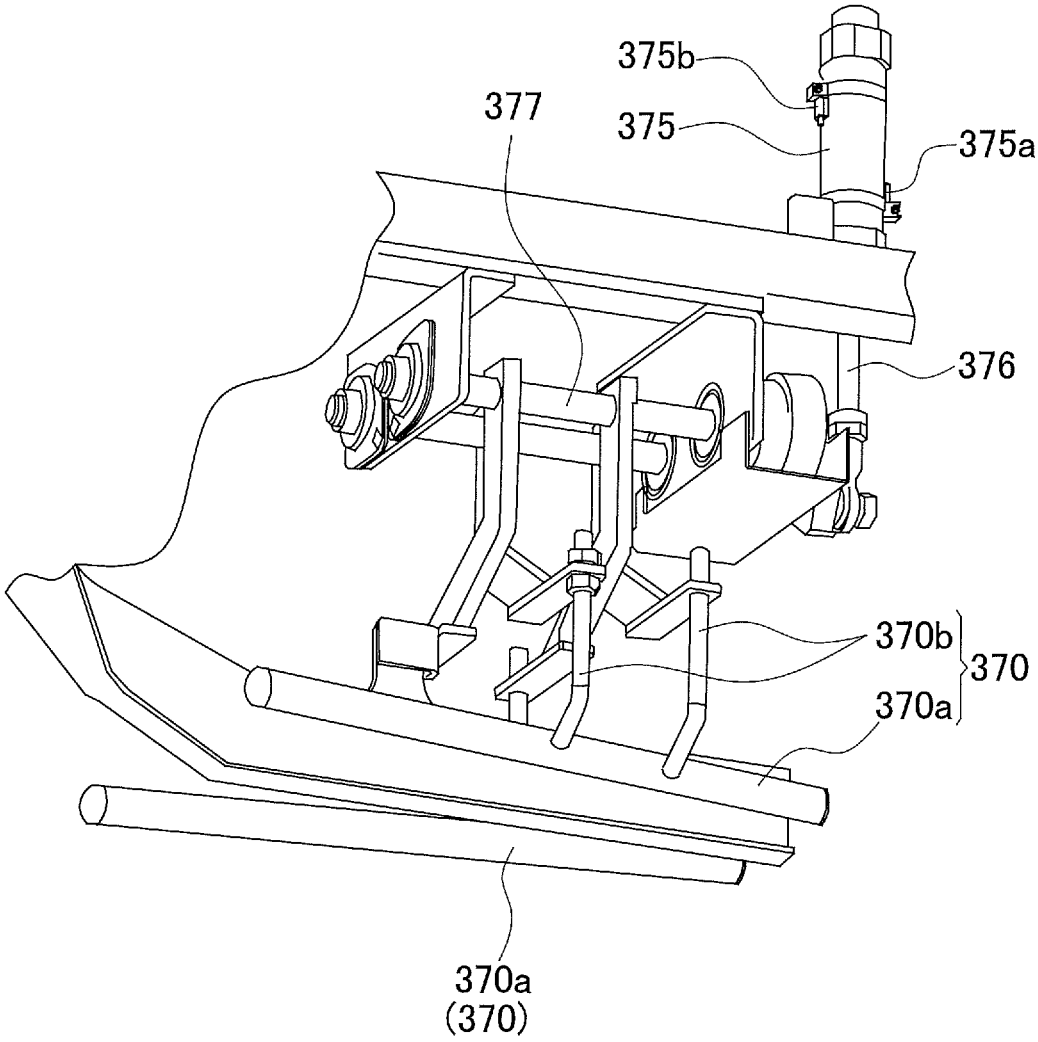
FIG. 6 is a perspective view of left/right flap folding members when the folding bars have descended to the lowest point.

FIG. 6 is a perspective view of the left/right flap folding members 370 when the folding bars 370*a* have descended to the lowest point, and FIG. 6 shows the left/right flap folding members 370 viewed from the opposite direction of the front view of FIG. 5. In FIG. 6, a leading end of a piston 376 of the folding air cylinder 375 is coupled to end portions of the crankshafts 377.

The folding bars 370*a* are coupled to the crankshafts 377 via the arms 370*b*, so when the piston 376 reciprocally moves through a total stroke, the crankshafts 377 turn and the folding bars 370*a* revolvingly operate.

A first sensor 375*a* and a second sensor 375*b* that detect the position of the piston 376 are attached to the folding air cylinder 375. The first sensor 375*a* is attached to the end portion of the folding air cylinder 375 on the piston 376 forward side, and the second sensor 375*b* is attached to the end portion of the folding air cylinder 375 on the piston 376 return side.

The first sensor 375*a* and the second sensor 375*b* switch on in response to a magnet attached beforehand to the piston 376 and output a Lo signal to the controller 40, and the first sensor 375*a* and the second sensor 375*b* switch off when they no longer respond to the magnet and output a Hi signal to the controller 40.

Consequently, the controller 40 can judge that the piston 376 has reached the terminal end of the forward stroke when the first sensor 375*a* switches on, and the controller 40 can judge that the piston 376 has reached the terminal end of the return stroke when the second sensor 375*b* switches on. FIG. 6 shows a state in which the piston 376 has reached the terminal end of the forward stroke, and the folding bars 370*a* have descended to the lowest point and are exactly in the state in FIG. 3D.

According to the left/right flap folding members 370, the folding bars 370*a* can gradually fold the left flap Zfal and the right flap Zfar from the front-side front edges of the left flap Zfal and the right flap Zfar in the conveyance direction to the rear sides, so the left flap Zfal and the right flap Zfar are reliably folded along the "fold lines" provided beforehand at their bases.

(4-3-3) Tape Applicator 380

The openings of the cardboard boxes B are closed as a result of the front flap Zfaa, the rear flap Zfab, the left flap Zfal, and the right flap Zfar being folded and are sealed by the tape applicator 380. The tape applicator 380 is installed near the discharge position on the conveyance path of the cardboard boxes B, and taping is performed before the cardboard boxes B reach the discharge position.

The tape applicator 380 guides, along the conveyance direction, the upper portions of both width direction side surfaces of the cardboard box B while applying tape to the cardboard box B.

(4-3-3-1) Guide Member 390

Figure 7:
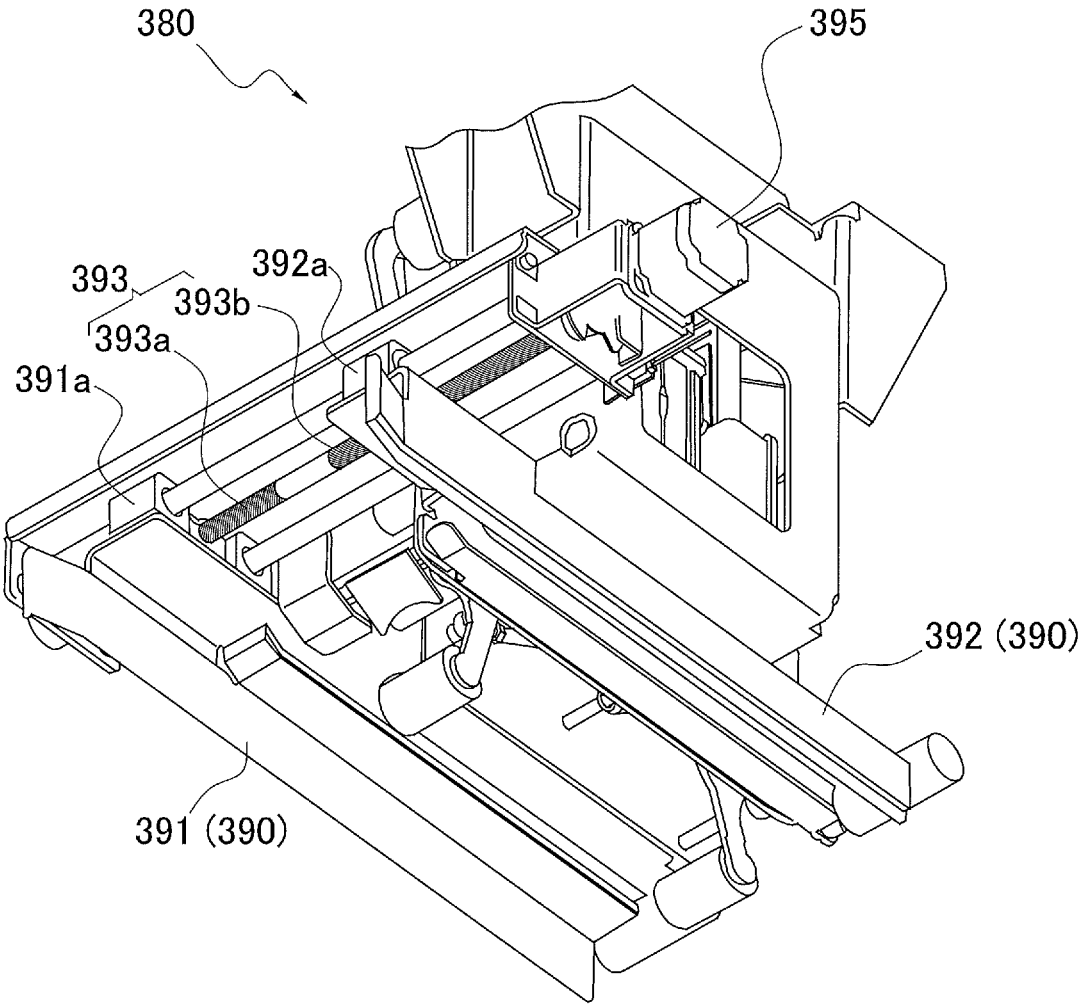
FIG. 7 is a perspective view of a guide member.

FIG. 7 is a perspective view of a guide member 390 and shows the tape applicator 380 of FIG. 5 as viewed from a direction looking up at the tape applicator 380 from below. In FIG. 7, the guide member 390 is located on the bottom portion of the tape applicator and has a pair of guide plates (391, 392) whose intervening distance can be changed.

One of the pair of guide plates will be called a first guide plate 391 and the other guide plate will be called a second guide plate 392. The first guide plate 391 and the second guide plate 392 are symmetrical with respect to a vertical plane parallel to the conveyance direction. End portions of the first guide plate 391 and the second guide plate 392 on the side that receives the cardboard boxes B conveyed thereto are inclined surfaces that widen outward heading closer to the ends, but except for those the first guide plate 391 and the second guide plate 392 are flat surfaces parallel to the conveyance direction of the cardboard boxes B.

(4-3-3-2) Adjustment of Distance in Guide Member 390

The first guide plate 391 is connected to a ball screw 393 via a first block 391*a*. In the same way, the second guide plate 392 is connected to the ball screw 393 via a second block 392*a*. The first block 391*a* and the second block 392*a* are both screwed to the ball screw 393.

A portion 393*a* of the ball screw 393 screwed to the first block 391*a* and a portion 393*b* of the ball screw 393 screwed to the second block 392*a* have opposite thread cut directions. Consequently, when the ball screw 393 rotates in one direction, the first block 391*a* and the second block 392*a* move in parallel in directions toward each other so that the distance between the first guide plate 391 and the second guide plate 392 decreases. When the ball screw 393 rotates in the opposite direction, the first block 391*a* and the second block 392*a* move in parallel in directions away from each other so that the distance between the first guide plate 391 and the second guide plate 392 increases.

One end of the ball screw 393 is connected to a stepping motor 395. In the present embodiment, when the ball screw 393 rotates in the clockwise direction as viewed from the stepping motor 395, the distance between the first guide plate 391 and the second guide plate 392 decreases, and when the ball screw 393 rotates in the counter-clockwise direction, the distance between the first guide plate 391 and the second guide plate 392 increases.

The controller 40 reads the width dimension of the cardboard boxes B from cardboard box size input data when production starts or when products are switched and causes the stepping motor 395 to rotate to thereby automatically adjust the distance between the first guide plate 391 and the second guide plate 392.

(5) Control

Up to now the configurations of each part of the packing system have been described together with their operations, but here control when there is a sensor malfunction in an air cylinder and control when there is a malfunction of an origin position sensor of the stepping motor, which perform operations that are special even among those, will be described.

(5-1) Control when there is a Sensor Malfunction in Air Cylinder 375

The packing system 1 has plural air cylinders as actuators, and sensors for detecting the positions of pistons are attached to each air cylinder. If a position detection sensor on any one air cylinder of the plural air cylinders fails, the entire packing system 1 is stopped and the sensor is replaced.

Consequently, if production is stopped until replacement of the sensor is finished and by chance the sensor is out of stock, the time in which the packing system 1 is stopped becomes prolonged and productivity significantly drops. In order to avoid such a situation, in the present embodiment the necessary operating time of each air cylinder is stored beforehand and even if a sensor fails the operating time is controlled by a timer, so that the operation of the packing system can be continued for a certain period of time.

Control when there is a position detection sensor malfunction will be described below with reference to flowcharts. Here, a case where either of the first sensor 375*a* and the second sensor 375*b* of the folding air cylinder 375 described in the section titled "(4-3-2-5) Left/Right Flap Folding Members 370" has failed will be described.

Figure 8A:
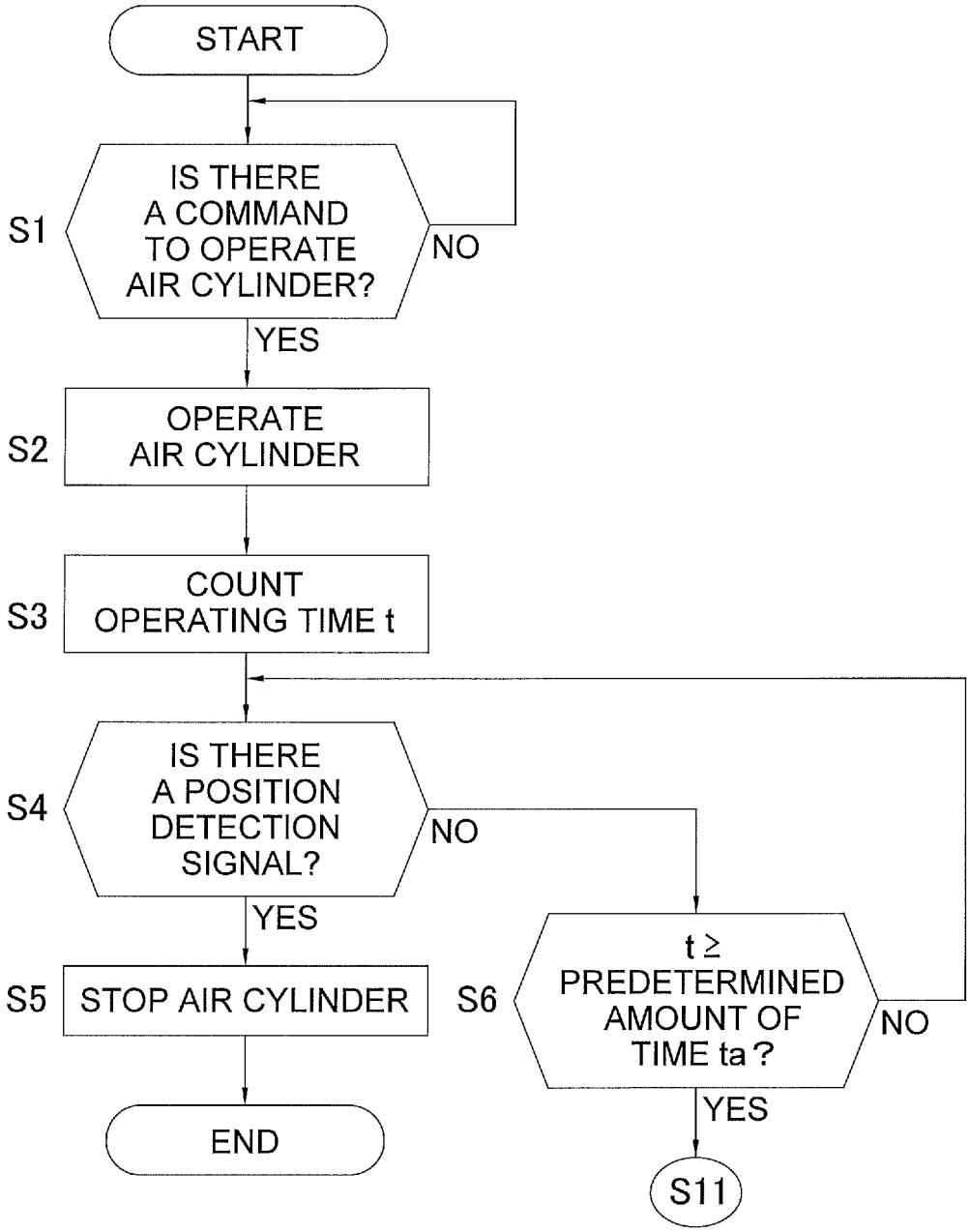
FIG. 8A is a flowchart of control when there is a sensor malfunction (a flow from step S1 to step S6)
Figure 8B:
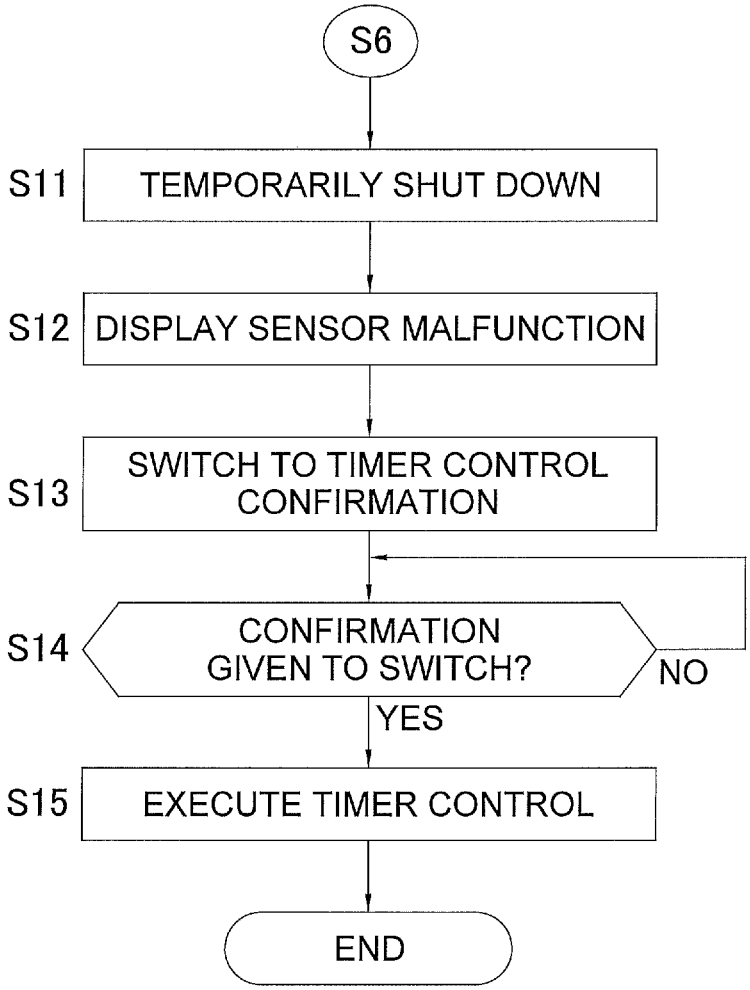
FIG. 8B is flowchart of control where there is a sensor malfunction (a flow from step S11 to step S15)

FIG. 8A and FIG. 8B are control flowcharts when there is a sensor malfunction. FIG. 8A shows a flow from step S1 to step S6, and FIG. 8B shows a flow from step S11 to step S15.

(5-1-1) Description of Flow in FIG. 8A (Step S1)

In FIG. 8A, the controller 40 determines whether or not there is a command to operate the folding air cylinder 375 in step S1. When there is an operation command, the controller 40 proceeds to step S2.

(Step S2)

Next, the controller 40 operates the folding air cylinder 375 in step S2. Then, the controller 40 proceeds to step S3.

(Step S3)

Next, the controller 40 counts an operating time t of the folding air cylinder 375 in step S3. Then, the controller 40 proceeds to step S4.

(Step S4)

Next, the controller 40 determines whether or not there is a detection signal from the first sensor 375*a* or the second sensor 375*b* in step S4. As described in the section titled "(4-3-2-5) Left/Right Flap Folding Members 370", when the first sensor 375*a* switches on, the controller 40 can judge that the piston 376 of the air cylinder 375 has reached the terminal end of the forward stroke, and when the second sensor 375*b* switches on, the controller 40 can judge that the piston 376 has reached the terminal end of the return stroke.

Consequently, when there is a detection signal from the first sensor 375*a* or the second sensor 3751), the controller 40 proceeds to step S5.

(Step S5)

The controller 40 stops the operation of the air cylinder in step S5.

(Step S6)

When there is no detection signal from the first sensor 375*a* or the second sensor 375*b* in the previous step S4, the controller 40 proceeds to step S6 and determines whether or not the operating time t has reached a predetermined amount of time ta.

Here, the predetermined amount of time ta is the necessary operating time, which comprises the design value of the operating time of the folding air cylinder 375 and error added thereto. The predetermined amount of time ta is stored in a memory 401 (see FIG. 9) built into the controller 40. The necessary operating time comprising the design value of the operating time of the folding air cylinder and error added thereto is ta=t1 in the forward stroke and ta=t2 in the return stroke.

Consequently, when t≥t1 in a case where the folding air cylinder 375 operated in the forward stroke, or when t≥t2 in a case where the folding air cylinder 375 operated in the return stroke, the controller 40 proceeds to step S11.

(5-1-2) Description of Flow in FIG. SB (Step S11)

In FIG. 8B, the controller 40 temporarily stops the operation of the packing system 1 in step S11. This is because the controller 40 judged previously in step S6 that there is a sensor malfunction because it did not receive a detection signal from the first sensor 375*a* or the second sensor 375*b* even though the operating time t reached the predetermined amount of time ta.

(Step S12)

The controller 40 performs a sensor malfunction display to notify the operator of the packing system 1 that there is a malfunction. If the packing system 1 has a display for display, the controller 40 displays the notification on the screen of the display. The controller 40 can also notify the operator using an alarm or an audio message, for example.

(Step S13)

Next, the controller 40 performs a switch to timer control confirmation. Specifically, the controller 40 asks, via a display 400 for display (see FIG. 9), the operator of the packing system 1 whether or not to perform a switch to timer control.

(Step S14)

Next, the controller 40 determines whether or not there is a confirmation to switch to timer control. When there is a confirmation to switch to timer control, the controller 40 proceeds to step S15, and when there is not a confirmation to switch to timer control, the controller 40 continues the determination. The controller 40 can, for example, have a configuration where the operator confirms the switch to timer control by touching a confirmation button displayed on the screen of the display 400 for display.

(Step S15)

In step S15 the controller 40 controls the operation of the forward stroke and the return stroke of the folding air cylinder 375 on the basis of the necessary operating time stored beforehand, without relying on the detection signal from the first sensor 375*a* or the second sensor 375*b*.

According to the above-described control, the operation of the air cylinder can be controlled by a timer, and the operation of the packing system 1 can be continued while ignoring the signals from the position detection sensors.

(5-2) Control when there is a Malfunction of Origin Position Sensor of Stepping Motor Control to operate and stop the actuators such as the folding air cylinder 375 can be performed using the necessary operating time stored beforehand, but using the operating time to control an actuator whose mechanical destructive power is large, such as a motor, is dangerous.

For example, in the case of a stepping motor whose position, for example, is decided by sensor detection, the necessary rotational amount can be output as a result of predetermined pulses being input, and when combined with an origin position sensor, by controlling the number of pulses input after detecting the position detection signal of the origin position sensor, a movable member coupled to the stepping motor can be moved to the intended position.

However, in a case where the origin position sensor has failed in a mechanism driven by the stepping motor, productivity significantly drops because the packing system 1 becomes shut down until the failed origin position sensor is replaced with a normal origin position sensor.

Meanwhile, in the stepping motor-driven mechanism, if its position is set once, there is no need to reset the position until the next product switching, so there are also circumstances where it is alright for the operator to manually set the position.

Therefore, in the present embodiment, control when there is a malfunction of the origin position sensor of the stepping motor as a stop-gap measure will be specifically described with reference to the drawings.

Figure 9:
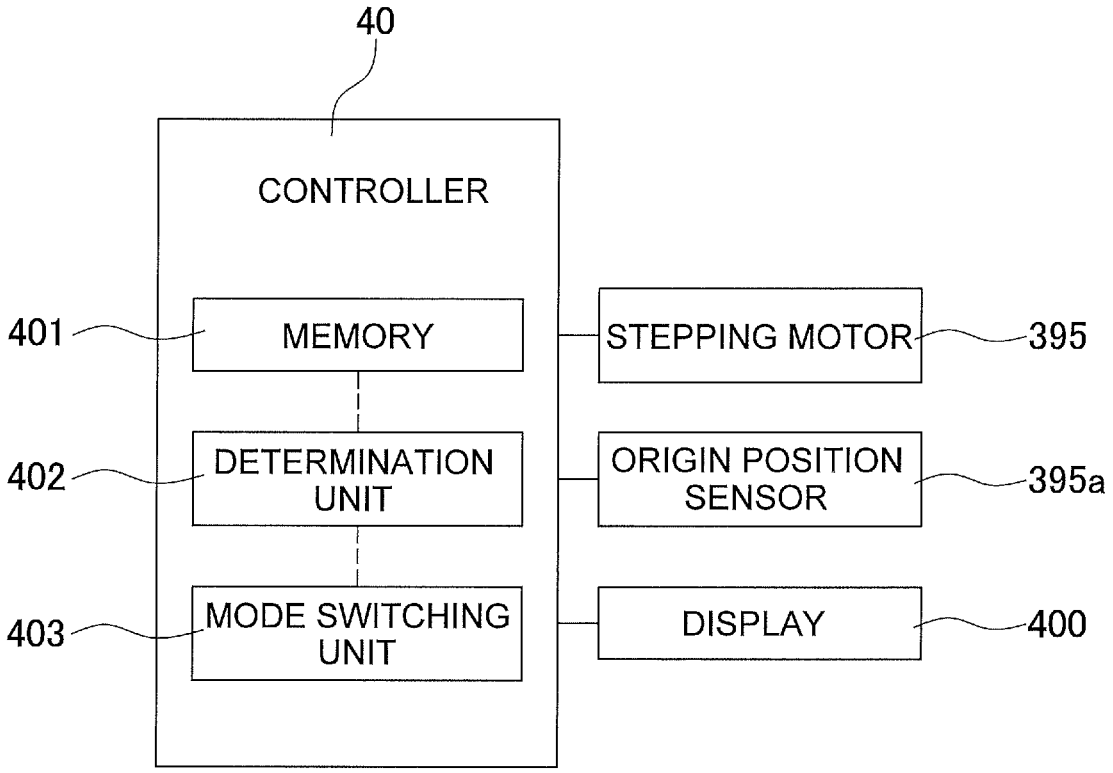
FIG. 9 is a control block diagram of a stepping motor shown in FIG. 7.

FIG. 9 is a control block diagram of an actuator such as the stepping motor 395 shown in FIG. 7. In FIG. 9, various sensors such as an origin position sensor 395*a* of the ball screw 393 driven by the stepping motor 395 are connected to the controller 40.

As mentioned in the section titled "(4-3-3-2) Adjustment of Distance in Guide Member 390" which has already been described, when the ball screw 393 rotates in the clockwise direction as viewed from the stepping motor 395, the distance between the first guide plate 391 and the second guide plate 392 decreases, and when the ball screw 393 rotates in the counter-clockwise direction, the distance between the first guide plate 391 and the second guide plate 392 increases.

In the memory 401 is stored the relationship between the rotational amount (number of input pulses) of the stepping motor 395 from an origin position and the distance between the first guide plate 391 and the second guide plate 392, and the controller 40 reads the width dimension of the cardboard boxes B from cardboard box size input data when production starts or when products are switched and causes the stepping motor 395 to rotate to thereby automatically adjust the distance between the first guide plate 391 and the second guide plate 392.

When a determination unit 402 determines that the origin position sensor 395*a* is malfunctioning, a mode switching unit 403 displays that the origin position sensor 395*a* is malfunctioning on the display 400 serving as a display unit, and preferably displays an indication that "The auto mode for adjusting the distance between the first guide plate 391 and the second guide plate 392 is inexecutable" and performs a display that asks "Would you like to manually adjust the distance between the first guide plate 391 and the second guide plate 392?"

It will be noted that as a specific example of the determination unit 402 determining that the origin position sensor 395*a* is malfunctioning, the determination unit 402 determines that the origin position sensor 395*a* is malfunctioning in a case where the position signal that should be detected is not being output from the origin position sensor 395*a* even though sufficient pulses are being input to the stepping motor 395.

In a case where the operator is able to soon replace the origin position sensor 395*a*, it suffices for the operator to replace the origin position sensor 395*a* with a normal origin position sensor 395*a*, without confirming the switch to the manual mode, and allow the auto mode to adjust the distance between the first guide plate 391 and the second guide plate 392.

On the other hand, in a case where the origin position sensor 395*a* is out of stock and it will take time to order another one, as a stop-gap measure until then the operator selects the manual mode, in which the operator manually performs the adjustment of the distance between the first guide plate 391 and the second guide plate 392, presses the confirmation button displayed on the screen of the display 400, and confirms the switch to the manual mode.

Because of this, even if the origin position sensor 395*a* of the ball screw 393 fails, by switching the adjustment of the distance between the first guide plate 391 and the second guide plate 392 to the manual mode, the operation of the packing system 1 can be continued while ignoring the signal of the origin position sensor 395*a*.

(6) Example Modifications

Here, example modifications that could not be described in the above embodiment and in which just some configurations are changed will be described.

In the above section titled "(4-3-2-3) Side Surface Pushing Mechanism 355" there was described employing a configuration where the friction surface 356*a* of the side surface pushing member 356 pushes the side surface of the cardboard box B so that the friction surface 356*a* and the side surface of the cardboard box B rub against each other.

However, because the function of the side surface pushing mechanism 355 is preventing uplift of the front or back of the cardboard box B, that function can also be realized by another configuration.

(6-1)

For example, the side surface of the cardboard box B can also be pushed by a rotatable roller instead of the friction surface 356*a*.

If the rotating shaft of the roller is vertically set, the roller rotates as a result of rubbing against the side surface of the cardboard box B, so the side surface of the cardboard box B being conveyed can be inhibited from being scratched.

(6-2)

Furthermore, by configuring the friction surface 356*a* to move in the conveyance direction of the cardboard box B, the friction surface 356*a* moves together with the cardboard box B while holding down the side surface of the cardboard box B, so the friction surface 356*a* is inhibited from rubbing against the side surface of the cardboard box B and the side surface of the cardboard box B being conveyed can be inhibited from being scratched.

(7) Characteristics of the Embodiment (7-1)

In the case sealing unit 33 of the packing system 1, the longitudinal directions of the folding bars 370*a* of the left/right flap folding members 370 are inclined with respect to the conveyance direction in such a way that the folding bars 370*a* come into contact with the front-side front edges of the left flap Zfal and the right flap Zfar in the conveyance direction, so the folding bars 370*a* can gradually fold the left flap Zfal and the right flap Zfar from the front-side front edges of the left flap Zfal and the right flap Zfar in the conveyance direction to the rear sides, and the left flap Zfal and the right flap Zfar are reliably folded along their fold lines.

(7-2)

Because the folding bars 370*a* gradually descend after they come into contact with the front-side front edges of the flaps, the folding operation becomes an operation where the folding bars 370*a* fold the left flap Zfal and the right flap Zfar from the upper portions of the left flap Zfal and the right flap Zfar to the bases, so the flaps can be folded neatly as if they were folded by hand.

(7-3)

In order to fold the left flap Zfal and the right flap Zfar, an operation that knocks them down from the side and at the same time holds them down from above becomes necessary, so an operation where the folding bars 370*a* descend obliquely downward is sensical. For that reason, the folding bars 370*a* descend while revolving.

(7-4)

The folding bars 370*a* are inclined with respect to the conveyance direction also when they are descending, so a folding operation where the folding bars 370*a* fold the left flap Zfal and the right flap Zfar from the upper portions to the bases from the front of the left flap Zfal and the right flap Zfar to the rear becomes possible, and the flaps can be folded neatly as if they were folded by hand.

(7-5)

The angle of inclination of the longitudinal directions of the folding bars 370*a* with respect to the conveyance direction of the cardboard boxes B is in the range of 3° to 60°.

(7-6)

The folding bars 370*a* are inclined with respect to a horizontal plane when they come into contact with the left flap Zfal and the right flap Zfar.

(7-7)

The folding bars 370*a* are provided in correspondence to each of the left flap Zfal and the right flap Zfar.

REFERENCE SIGNS LIST

33 Case Sealing Unit (Case Sealing Device)
370 Left/Right Flap Folding Members (Folding Members)
370*a* Folding Bars (Folding Members)
370*b* Arms (Folding Members)
375 Folding Air Cylinder (Drive Unit)
40 Controller
B Cardboard Boxes
Zfal Left Flap (Flap)
Zfar Right Flap (Flap)

What is claimed is:

1. A case sealing device that conveys a cardboard box and simultaneously closes a flap group provided on edges of opening of the cardboard box, the case sealing device comprising:

a folding member that contacts a flap of the flap group that extends along a conveyance direction of the cardboard box and folds the flap;

a drive unit that moves the folding member; and a control unit that controls the drive unit, wherein in operation of folding the flap, a longitudinal direction of the folding member is inclined with respect to the conveyance direction such that the folding member contacts a front edge of the flap in the conveyance direction before other portions of the flap, and the folding member moves from the outside to the inside of the cardboard box with respect to a direction orthogonal to the conveyance direction to fold the flap.

2. The case sealing device according to claim 1, wherein the folding member gradually descends after contacting the front edge of the flap.

3. The case sealing device according to claim 2, wherein the folding member descends obliquely downward.

4. The case sealing device according to claim 2, wherein the folding member descends while revolving.

5. The case sealing device according to claim 2, wherein the folding member is inclined with respect to the conveyance direction when descending.

6. The case sealing device according to claim 1, wherein an angle of inclination of the longitudinal direction of the folding member with respect to the conveyance direction is in a range of 3° to 60°.

7. The case sealing device according to claim 1, wherein the folding member is inclined with respect to a horizontal plane when the folding member contacts the flap.

8. The case sealing device according to claim 1, wherein the folding member includes a plurality of folding members provided for each of the flaps that extend along the conveyance direction.

* * * * *